US011730664B2

(12) United States Patent
Gebre

(10) Patent No.: US 11,730,664 B2
(45) Date of Patent: Aug. 22, 2023

(54) ACHILLES TENDON MASSAGE ASSEMBLY

(71) Applicant: Yohannes Gebre, Arden Hills, MN (US)

(72) Inventor: Yohannes Gebre, Arden Hills, MN (US)

( * ) Notice: Subject to any disclaimer, the term of this patent is extended or adjusted under 35 U.S.C. 154(b) by 457 days.

(21) Appl. No.: 17/094,290

(22) Filed: Nov. 10, 2020

(65) Prior Publication Data

US 2022/0142853 A1 May 12, 2022

(51) Int. Cl.
*A61H 15/00* (2006.01)

(52) U.S. Cl.
CPC . *A61H 15/0078* (2013.01); *A61H 2015/0014* (2013.01); *A61H 2201/1215* (2013.01); *A61H 2201/1642* (2013.01); *A61H 2201/5002* (2013.01); *A61H 2201/5025* (2013.01); *A61H 2203/0406* (2013.01); *A61H 2205/12* (2013.01)

(58) Field of Classification Search
CPC ..... A61H 15/00–078; A61H 2015/0007–0071
USPC ..... 601/115
See application file for complete search history.

(56) References Cited

U.S. PATENT DOCUMENTS

| | | | | |
|---|---|---|---|---|
| 2,096,646 | A | 10/1937 | Thornton-Norris | |
| 5,772,615 | A * | 6/1998 | Elder | A61H 15/0078 601/102 |
| D420,450 | S | 2/2000 | Anthony | |
| 7,509,755 | B2 * | 3/2009 | Avanzini | A47K 10/48 34/235 |
| 8,105,253 | B2 | 1/2012 | Chen | |
| 9,839,575 | B2 | 12/2017 | Slocum | |
| 11,129,768 | B1 * | 9/2021 | Gresham | A61H 15/0078 |
| 2002/0156404 | A1 * | 10/2002 | Kuo | A61H 15/0078 601/87 |
| 2002/0183664 | A1 * | 12/2002 | Lu | A61H 39/04 601/28 |
| 2003/0181836 | A1 | 9/2003 | Cameron | |

(Continued)

FOREIGN PATENT DOCUMENTS

| | | | | |
|---|---|---|---|---|
| KR | 20060013904 A | * | 2/2006 | A61H 39/04 |
| KR | 20100079950 A | * | 7/2010 | A63B 22/0285 |
| WO | WO2018121915 | | 5/2018 | |

OTHER PUBLICATIONS

Translation of KR 20100079950 A. Accessed from Espaceneton Apr. 4, 2023. (Year: 2010).*

(Continued)

*Primary Examiner* — Valerie L Woodward
*Assistant Examiner* — Paige Kathleen Bugg

(57) ABSTRACT

An Achilles tendon massage assembly includes a housing that can have a user stand thereon. The housing has a pair of foot wells integrated for having a respective user's foot placed therein. A pair of massaging units is each movably integrated into the housing and each of the massaging units includes a pair of massage rollers. Each of the massage rollers is positioned in a respective one of the foot wells to frictionally engage the Achilles tendon on a respective user's foot when the user's feet are positioned in the foot wells. Each of the massage rollers in each of the massage units rotates when the massage units are turned on. In this way each of the massage rollers of each of the massage units can massage the Achilles tendon on the respective user's foot.

13 Claims, 5 Drawing Sheets

(56) References Cited

U.S. PATENT DOCUMENTS

| | | | | |
|---|---|---|---|---|
| 2007/0038165 | A1* | 2/2007 | Trandafir | A61H 23/0218 601/51 |
| 2009/0227912 | A1 | 9/2009 | Enami | |
| 2015/0209219 | A1* | 7/2015 | Hen | A61H 15/0078 601/118 |

OTHER PUBLICATIONS

Translation of KR 20060013904 A. Accessed from Espaceneton Apr. 4, 2023. (Year: 2006).*

* cited by examiner

ACHILLES TENDON MASSAGE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to massage devices and more particularly pertains to a new massage device for massaging a user's Achilles tendons.

(2) Description of Related Art Including Information Disclosed Under 37 CFR 1.97 and 1.98

The prior art relates to massage devices including a kneading massager that includes cylindrical massage rollers. The prior art discloses a variety of foot massagers that employ a massaging ball to massage a user's foot.

BRIEF SUMMARY OF THE INVENTION

An embodiment of the disclosure meets the needs presented above by generally comprising a housing that can have a user stand thereon. The housing has a pair of foot wells integrated for having a respective user's foot placed therein. A pair of massaging units is each movably integrated into the housing and each of the massaging units includes a pair of massage rollers. Each of the massage rollers is positioned in a respective one of the foot wells to frictionally engage the Achilles tendon on a respective user's foot when the user's feet are positioned in the foot wells. Each of the massage rollers in each of the massage units rotates when the massage units are turned on. In this way each of the massage rollers of each of the massage units can massage the Achilles tendon on the respective user's foot.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
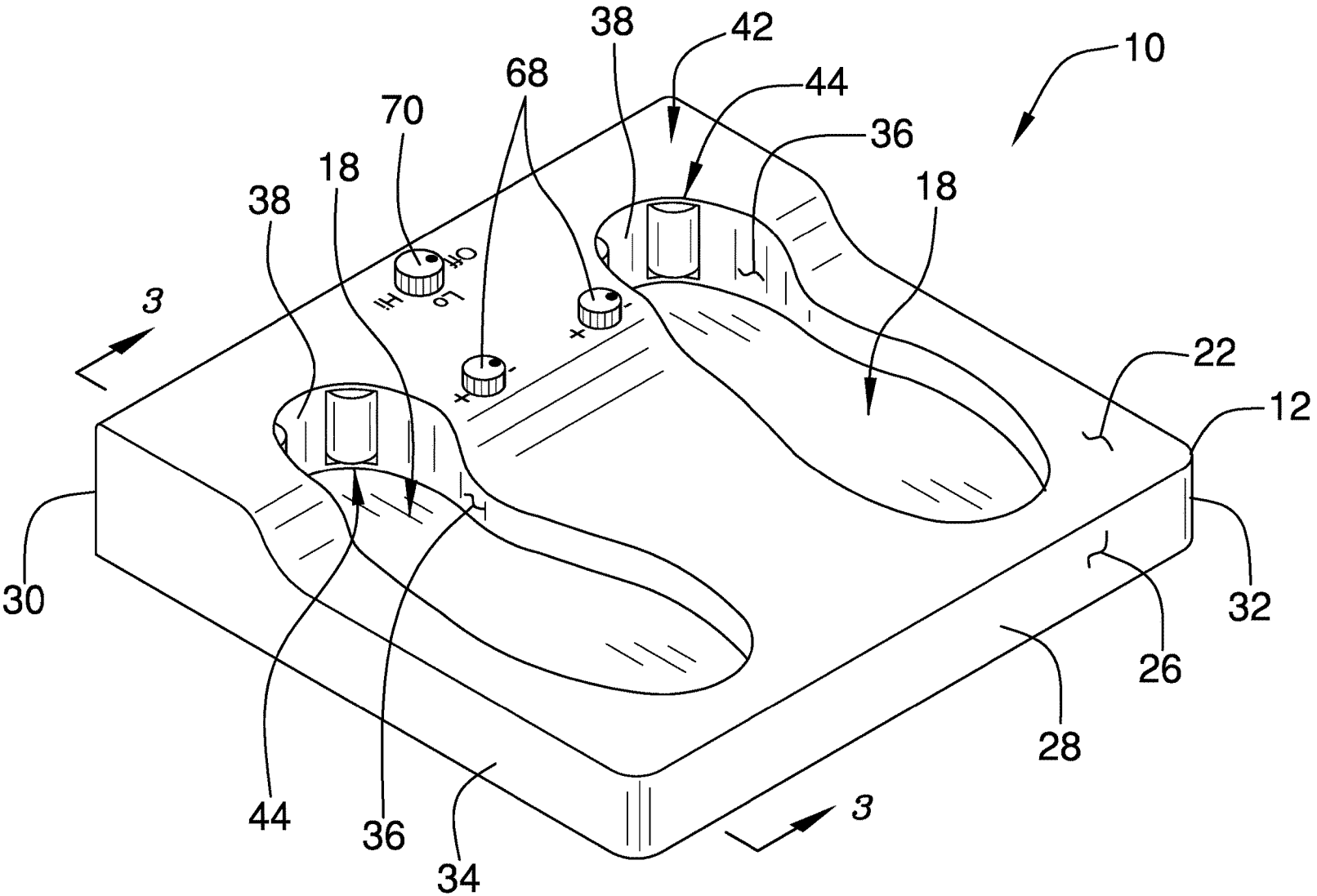
FIG. 1 is a top perspective view of an Achilles tendon massage assembly according to an embodiment of the disclosure.
Figure 2:
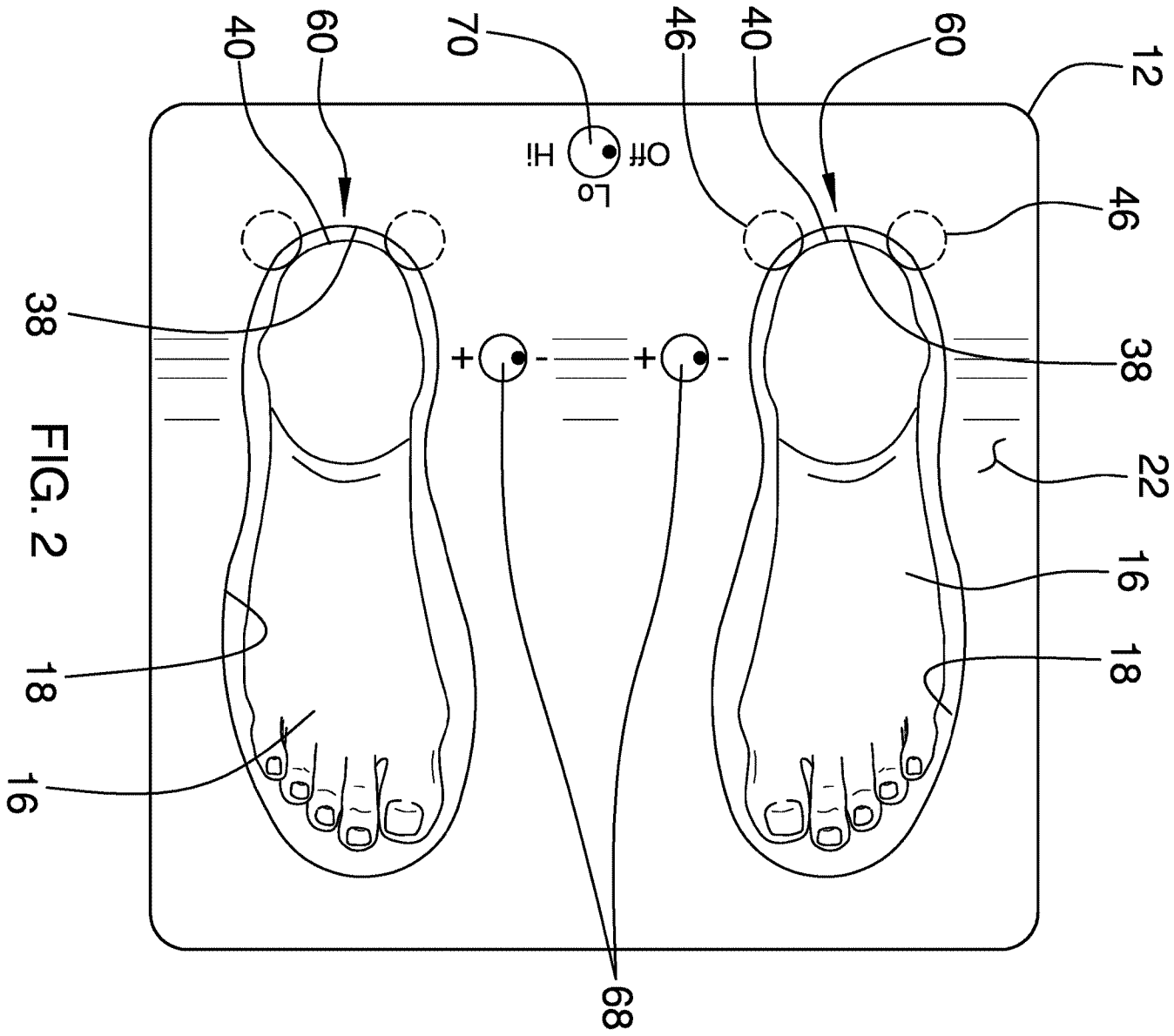
FIG. 2 is a top in-use view of an embodiment of the disclosure.
Figure 3:
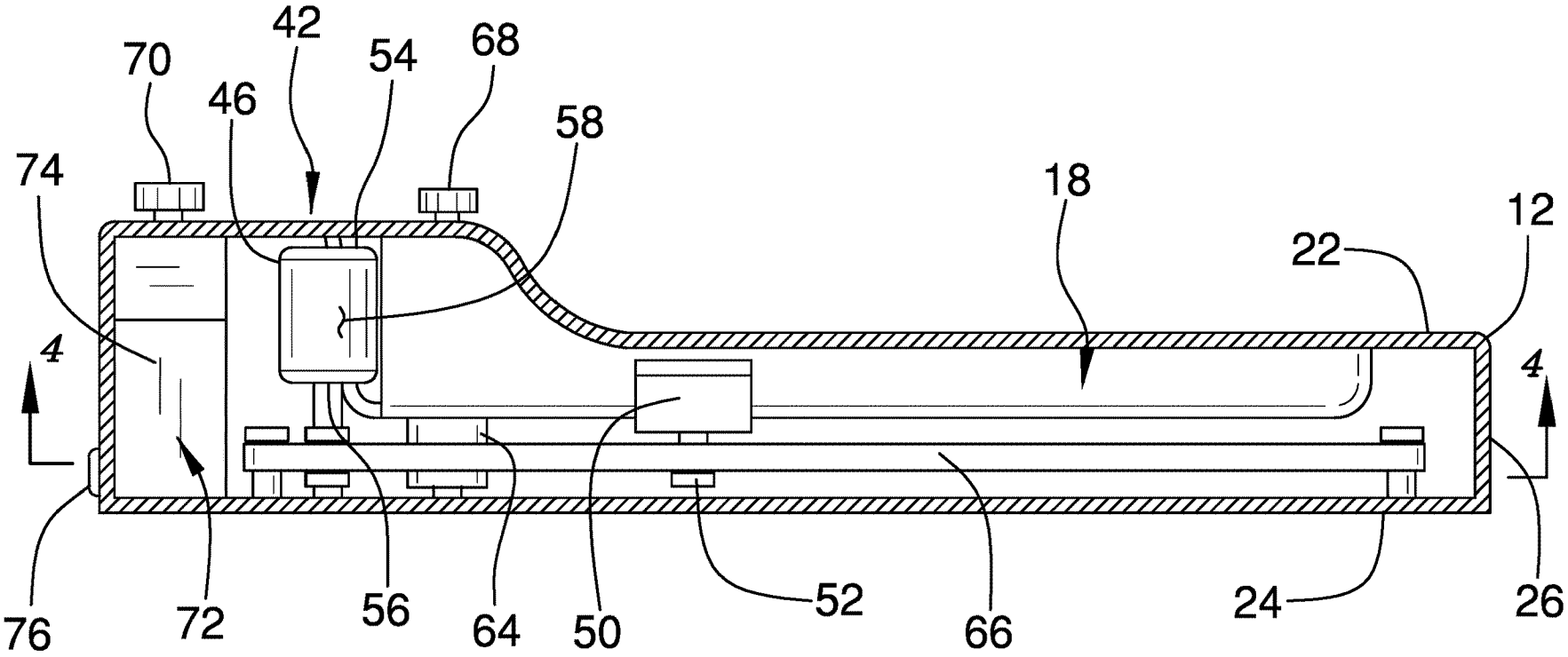
FIG. 3 is a cross sectional view taken along line 3-3 of FIG. 1 of an embodiment of the disclosure.
Figure 4:
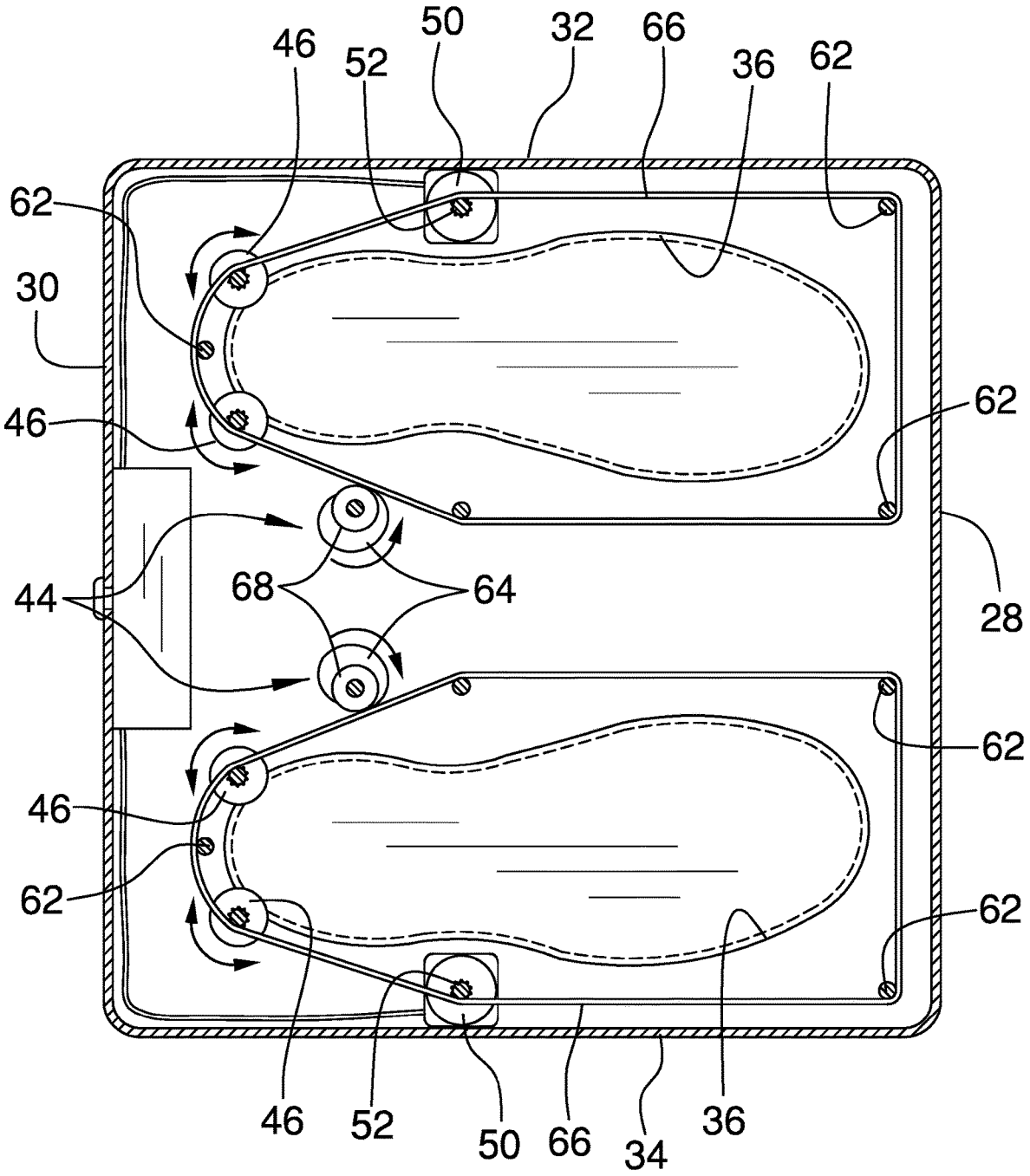
FIG. 4 is a cross sectional view taken along line 4-4 of FIG. 3 of an embodiment of the disclosure.
Figure 5:
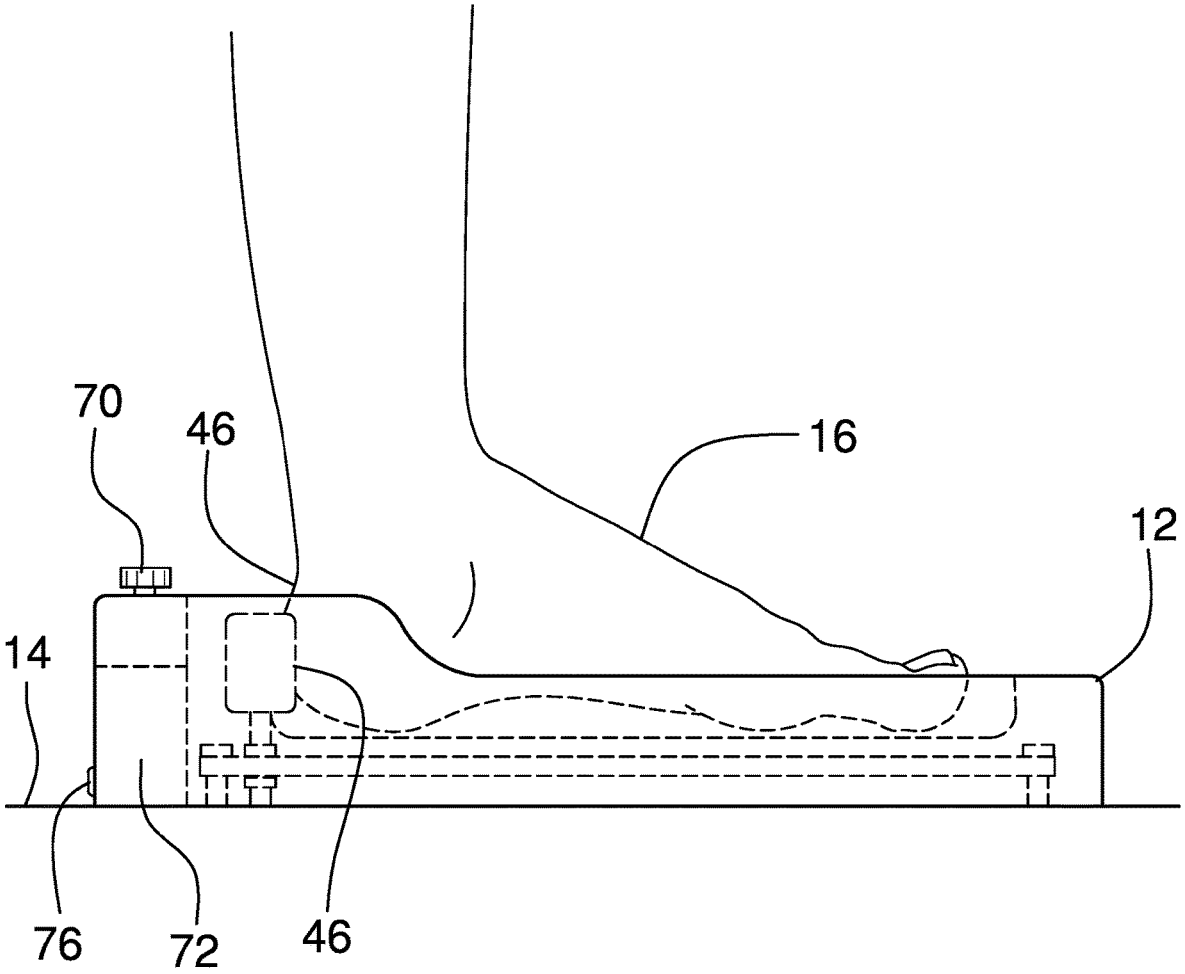
FIG. 5 is a phantom in-use view of an embodiment of the disclosure.

With reference now to the drawings, and in particular to FIGS. 1 through 5 thereof, a new massage device embodying the principles and concepts of an embodiment of the disclosure and generally designated by the reference numeral 10 will be described.

As best illustrated in FIGS. 1 through 5, the Achilles tendon massage assembly 10 generally comprises a housing 12 that is positionable on a horizontal support surface 14 for having a user 16 stand thereon. The housing 12 has a pair of foot wells 18 each being integrated therein to have a respective user's foot 20 placed therein. The housing 12 has a top surface 22, a bottom surface 24 and a perimeter surface 26 extending therebetween, and the perimeter surface 26 has a front side 28, a back side 30, a first lateral side 32 and a second lateral side 34. Each of the foot wells 18 extends downwardly in the top surface 22 toward the bottom surface 24 and each of the foot wells 18 has a lateral bounding surface 36.

Each of the foot wells 18 is elongated to extend substantially between the back side 30 and the front side 28. Moreover, the foot wells 18 are positioned on opposite sides of a center line extending between the back side 30 and the front side 28 of the perimeter surface 26. The lateral bounding surface 36 of each of the foot wells 18 follows an oval-like path. In this way each of the foot wells 18 can accommodate one of the user's feet 20. The lateral bounding surface 36 of each of the foot wells 18 has a heel portion 38 that is concavely arcuate to curve around the user's heel 40. Additionally, the top surface 22 has a raised portion 42 extending between the first lateral side 32 and the second lateral side 34 of the perimeter surface 26 of the housing 12, and the raised portion 42 extends from the back side 30 toward the front side 28.

A pair of massaging units 44 is provided and each of the massaging units 44 is movably integrated into the housing 12. Each of the massaging units 44 includes a pair of massage rollers 46 and each of the massage rollers 46 is positioned in a respective one of the foot wells 18. In this way each of the massage rollers 46 can frictionally engage the Achilles tendon 48 on a respective user's foot 20 when the user 16's feet are positioned in the foot wells 18. Each of the massage rollers 46 in each of the massaging units 46 rotates when the massaging units 46 are turned on. In this way each of the massage rollers 46 of each of the massaging units 46 can massage the Achilles tendon 48 on the respective user's foot 20.

Each of the massaging units 46 comprises a motor 50 that is positioned in the housing 12. The motor 50 rotating in a first direction when the motor 50 is turned on and the motor 50 includes a drive shaft 52. The motor 50 may comprise an electric motor or the like. Each of the massage rollers 46 has a first end 54, a second end 56 and an outer surface 58 extending therebetween, and each of the massage rollers 46 is positioned in the housing 12. Moreover, each of the massage rollers 46 extends through the lateral bounding surface 36 of a respective one of the foot wells 18 such that the outer surface 58 of each of the massage rollers 46 is exposed. Each of the massage rollers 46 is positioned on opposite sides of an apex 60 of the heel portion 38 of the lateral bounding surface 36 of the respective foot well. In this way the outer surface 58 of each of the massage rollers 46 abuts opposite sides of the user 16's Achilles tendon 48.

Each of the massaging units 46 includes a plurality of belt guides 62 that is each rotatably integrated into the housing 12. The belt guides 62 are spaced apart from each other and are distributed around the lateral bounding surface 36 of a respective one of the foot wells 18. Each of the massaging units 46 includes a tensioner roller 64 that is rotatably integrated into the housing 12 and the tensioner roller 64 is positioned between a respective pair of the belt guides 62.

Each of the massaging units 46 includes a belt 66 that extends around each of the belt guides 62, the drive shaft 52 of the motor 50, each of the massage rollers 46 and the tensioner roller 64. Moreover, the belt 66 rotates each of the massage rollers 46 about an axis extending through the first end 54 and the second end 56 of the massage rollers 46 when the motor 50 is turned on. Each of the massaging units 46 includes a knob 68 that is coupled to the tensioner roller 64 and the knob 68 is disposed on the top surface 22 of the housing 12 such that the knob 68 can be rotated by the user 16. The knob 68 is offset from a rotational axis of the tensioner roller 64. Thus, the tensioner roller 64 is urged to press against the belt 66 when the knob 68 is rotated in a tightening thereby reducing slippage of the belt 66 on the massage rollers 46. In this way the tensioner roller 64 increases the intensity with which the user 16's Achilles tendon 48 is massaged. The tensioner roller 64 is urged to move away from the belt 66 when the knob 68 is rotated in a loosening direction thereby increasing slippage of the belt 66 on the massage rollers 46. In this way the tensioner roller 64 can decrease the intensity with which the user 16's Achilles tendon 48 is massaged.

A power knob 70 is rotatably disposed on the top surface 22 of the housing 12 such that the power knob 70 can be rotated by the user 16. The power knob 70 is electrically coupled to the motor 50 and the power knob 70 is positionable in an off position having the motor 50 being turned off. The power knob 70 is positionable in a low position having the motor 50 rotating at a minimum speed. Additionally, the power knob 70 is positionable in a high position having the motor 50 rotating at a maximum speed.

A power supply 72 is integrated into the housing 12 and the power supply 72 is electrically coupled to the power knob 70. The power supply 72 comprises a rechargeable battery 74 is positioned within the housing 12 and the rechargeable battery 74 is electrically coupled to the power knob 70. The power supply 72 includes a power port 76 that is recessed into the perimeter surface 26 of the housing 12 to receive a charge cord from a charger. Additionally, the power port 76 is electrically coupled to the rechargeable battery 74 for charging the rechargeable battery 74.

In use, the user 16 stands in each of the foot wells 18 and the power knob 70 is manipulated to either the low position or the high position, depending on the user 16's preference. In this way the massage rollers 46 are rotated to massage the user 16's Achilles tendon 48*s*. The knob 68 associated with each of the massaging units 46 is manipulated to adjust the intensity of the massage. In this way the user 16 can massage their Achilles tendon 48 on each foot for relief from bone spurs, inflammation or any other physical discomfort associated with the Achilles tendon 48.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An Achilles tendon massage assembly for massaging a user's Achilles tendon for treating bone spurs, said assembly comprising:

a housing being positionable on a horizontal support surface wherein said housing is configured to have a user stand thereon, said housing having a pair of foot wells each being integrated therein, wherein each of said foot wells is configured to have a respective user's foot placed therein, wherein said housing has a top surface, a bottom surface and a perimeter surface extending therebetween, said perimeter surface having a front side, a back side, a first lateral side and a second lateral side, each of said foot wells extending downwardly in said top surface toward said bottom surface, each of said foot wells having a lateral bounding surface and each of said foot wells is elongated to extend substantially between said back side and said front side, said foot wells being positioned on opposite sides of a center line extending between said back side and said front side of said perimeter surface, said lateral bounding surface of each of said foot wells following an oval-like path wherein each of said foot wells is configured to receive one of the user's feet, said lateral bounding surface of each of said foot wells having a heel portion that is concavely arcuate and said heel portion is configured to curve around the user's heel;

a pair of massaging units, each of said massaging units being movably integrated into said housing, each of said massaging units including a pair of massage rollers, each of said massage rollers being positioned in a respective one of said foot wells wherein each of said massage rollers is configured to frictionally engage the Achilles tendon on a respective user's foot when the user's feet are positioned in said foot wells, each of said massage rollers in each of said massage units rotating when said massage units are turned on wherein each of said massage rollers of each of said massage units is configured to massage the Achilles tendon on the respective user's foot wherein each of said massage units includes a plurality of belt guides, each of said belts guides being rotatably integrated into said housing, said belt guides being spaced apart from each other and being distributed around said lateral bounding surface of a respective one of said foot wells.

2. The assembly according to claim 1, wherein said top surface has a raised portion extending between said first lateral side and said second lateral side of said perimeter surface of said housing, said raised portion extending from said back side toward said front side.

3. The assembly according to claim 1, wherein each of said massage units comprises a motor being positioned in said housing, said motor rotating in a first direction when said motor is turned on, said motor including a drive shaft.

4. The assembly according to claim 1, wherein each of said massage rollers has a first end, a second end and an outer surface extending therebetween, each of said massage rollers being positioned in said housing, each of said massage rollers extending through said lateral bounding surface of a respective one of said foot wells such that said outer surface of each of said massage rollers is exposed.

5. The assembly according to claim 4, wherein each of said massage rollers is positioned on opposite sides of an apex of said heel portion of said lateral bounding surface of said respective foot well wherein said outer surface of each of said massage rollers is configured to abut opposite sides of the user's Achilles tendon.

6. The assembly according to claim 1, wherein each of said massage units includes a tensioner roller being rotatably integrated into said housing, said tensioner roller being positioned between a respective pair of said belt guides.

7. The assembly according to claim 6, wherein each of said massage units includes:

a motor being positioned in said housing, said motor rotating in a first direction when said motor is turned on, said motor including a drive shaft; and a belt extending around each of said belt guides, said drive shaft of said motor, each of said massage rollers and said tensioner roller, said belt rotating each of said massage rollers about an axis extending through said first end and said second end of said massage rollers when said motor is turned on.

8. The assembly according to claim 7, wherein each of said massage units comprises a knob being coupled to said tensioner roller, said knob being disposed on said top surface of said housing wherein said knob is configured to be rotated by the user, said knob being offset from a rotational axis of said tensioner roller.

9. The assembly according to claim 8, wherein said tensioner roller is urged to press against said belt when said knob is rotated in a tightening direction thereby reducing slippage of said belt on said massage rollers wherein said tensioner roller is configured to increase the intensity with which the user's Achilles tendon is massaged.

10. The assembly according to claim 8, wherein said tensioner roller is urged to move away from said belt when said knob is rotated in a loosening direction thereby increasing slippage of said belt on said massage rollers wherein said tensioner roller is configured to decrease the intensity with which the user's Achilles tendon is massaged.

11. The assembly according to claim 6, further comprising a power knob being rotatably disposed on said top surface of said housing wherein said power knob is configured to be rotated by the user, said power knob being electrically coupled to said motor, said power knob being positionable in an off position having said motor being turned off, said power knob being positionable in a low position having said motor rotating at a minimum speed, said power knob being positionable in a high position having said motor rotating at a maximum speed.

12. The assembly according to claim 11, further comprising a power supply being integrated into said housing, said power supply being electrically coupled to said power knob, said power supply comprising:

a rechargeable battery being positioned within said housing, said rechargeable battery being electrically coupled to said power knob; and a power port being recessed into said perimeter surface of said housing wherein said power port is configured to receive a charge cord from a charger, said power port being electrically coupled to said rechargeable battery for charging said rechargeable battery.

13. An Achilles tendon massage assembly for massaging a user's Achilles tendon for treating bone spurs, said assembly comprising:

a housing being positionable on a horizontal support surface wherein said housing is configured to have a user stand thereon, said housing having a pair of foot wells each being integrated therein, wherein each of said foot wells is configured to have a respective user's foot placed therein, said housing having a top surface, a bottom surface and a perimeter surface extending therebetween, said perimeter surface having a front side, a back side, a first lateral side and a second lateral side, each of said foot wells extending downwardly in said top surface toward said bottom surface, each of said foot wells having a lateral bounding surface, each of said foot wells being elongated to extend substantially between said back side and said front side, said foot wells being positioned on opposite sides of a center line extending between said back side and said front side of said perimeter surface, said lateral bounding surface of each of said foot wells following an oval-like path wherein each of said foot wells is configured to receive one of the user's feet, said lateral bounding surface of each of said foot wells having a heel portion being concavely arcuate wherein said heel portion is configured to curve around the user's heel, said top surface having a raised portion extending between said first lateral side and said second lateral side of said perimeter surface of said housing, said raised portion extending from said back side toward said front side;

a pair of massaging units, each of said massaging units being movably integrated into said housing, each of said massaging units including a pair of massage rollers, each of said massage rollers being positioned in a respective one of said foot wells wherein each of said massage rollers is configured to frictionally engage the Achilles tendon on a respective user's foot when the user's feet are positioned in said foot wells, each of said massage rollers in each of said massage units rotating when said massage units are turned on wherein each of said massage rollers of each of said massage units is configured to massage the Achilles tendon on the respective user's foot, each of said massage units comprising:

a motor being positioned in said housing, said motor rotating in a first direction when said motor is turned on, said motor including a drive shaft;

each of said massage rollers having a first end, a second end and an outer surface extending therebetween, each of said massage rollers being positioned in said housing, each of said massage rollers extending through said lateral bounding surface of a respective one of said foot wells such that said outer surface of each of said massage rollers is exposed, each of said massage rollers being positioned on opposite sides of an apex of said heel portion of said lateral bounding surface of said respective foot well wherein said outer surface of each of said massage rollers is configured to abut opposite sides of the user's Achilles tendon;

a plurality of belt guides, each of said belts guides being rotatably integrated into said housing, said belt guides being spaced apart from each other and being distributed around said lateral bounding surface of a respective one of said foot wells;

a tensioner roller being rotatably integrated into said housing, said tensioner roller being positioned between a respective pair of said belt guides;

a belt extending around each of said belt guides, said drive shaft of said motor, each of said massage rollers and said tensioner roller, said belt rotating each of said massage rollers about an axis extending through said first end and said second end of said massage rollers when said motor is turned on; and a knob being coupled to said tensioner roller, said knob being disposed on said top surface of said housing wherein said knob is configured to be rotated by the user, said knob being offset from a rotational axis of said tensioner roller, said tensioner roller being urged to press against said belt when said knob is rotated in a tightening direction thereby reducing slippage of said belt on said massage rollers wherein said tensioner roller is configured to increase the intensity with which the user's Achilles tendon is massaged, said tensioner roller being urged to move away from said belt when said knob is rotated in a loosening direction thereby increasing slippage of said belt on said massage rollers wherein said tensioner roller is configured to decrease the intensity with which the user's Achilles tendon is massaged;

a power knob being rotatably disposed on said top surface of said housing wherein said power knob is configured to be rotated by the user, said power knob being electrically coupled to said motor, said power knob being positionable in an off position having said motor being turned off, said power knob being positionable in a low position having said motor rotating at a minimum speed, said power knob being positionable in a high position having said motor rotating at a maximum speed; and a power supply being integrated into said housing, said power supply being electrically coupled to said power knob, said power supply comprising:

a rechargeable battery being positioned within said housing, said rechargeable battery being electrically coupled to said power knob; and a power port being recessed into said perimeter surface of said housing wherein said power port is configured to receive a charge cord from a charger, said power port being electrically coupled to said rechargeable battery for charging said rechargeable battery.

* * * * *